United States Patent [19]

Ortwein

[11] Patent Number: 4,720,043

[45] Date of Patent: Jan. 19, 1988

[54] RESILIENT BALLAST UNDERLAYMENT MAT INCLUDING NONWOVEN FIBER FLEECE LAYERS

[75] Inventor: Hermann Ortwein, Köln, Fed. Rep. of Germany

[73] Assignee: Clouth Gummiwerke Aktiengesellschaft, Köln, Fed. Rep. of Germany

[21] Appl. No.: 832,513

[22] Filed: Feb. 21, 1986

[30] Foreign Application Priority Data

Feb. 23, 1985 [DE] Fed. Rep. of Germany ..... 3506505

[51] Int. Cl.[4] ..... E01B 1/00; B32B 17/02

[52] U.S. Cl. ..... 238/2; 428/285; 404/31

[58] Field of Search ..... 238/2–9; 404/28, 31, 45, 82; 428/285, 492, 284, 287

[56] References Cited

U.S. PATENT DOCUMENTS

| | | | |
|---|---|---|---|
| 2,165,955 | 7/1939 | Haarhoff | 404/31 |
| 3,568,579 | 3/1971 | Hoad | 404/45 |
| 3,587,964 | 6/1971 | Cork | 404/31 |
| 4,025,686 | 5/1977 | Zion | 428/285 |
| 4,235,371 | 11/1980 | Kohler | 404/31 |
| 4,311,273 | 1/1982 | Marsh | 238/2 |
| 4,353,947 | 10/1982 | Northcut | 428/284 |
| 4,362,780 | 12/1982 | Marzocchi et al. | 428/285 |
| 4,368,844 | 1/1983 | Miller | 238/2 |

FOREIGN PATENT DOCUMENTS

| | | | |
|---|---|---|---|
| 3019531 | 11/1981 | Fed. Rep. of Germany | 238/2 |

*Primary Examiner*—Robert B. Reeves
*Assistant Examiner*—John Pido
*Attorney, Agent, or Firm*—Karl F. Ross; Herbert Dubno

[57] ABSTRACT

A road bed for railway rails comprises a ballast underlayment mat in the form of a body of elastomeric material. The mat has, at its bottom, prominent projecting parts of the elastomeric material and is covered by stone ballast. At least one fiber fleece layer on the top of the mat limits penetration of the stone ballast into the elastomeric material.

5 Claims, 1 Drawing Figure

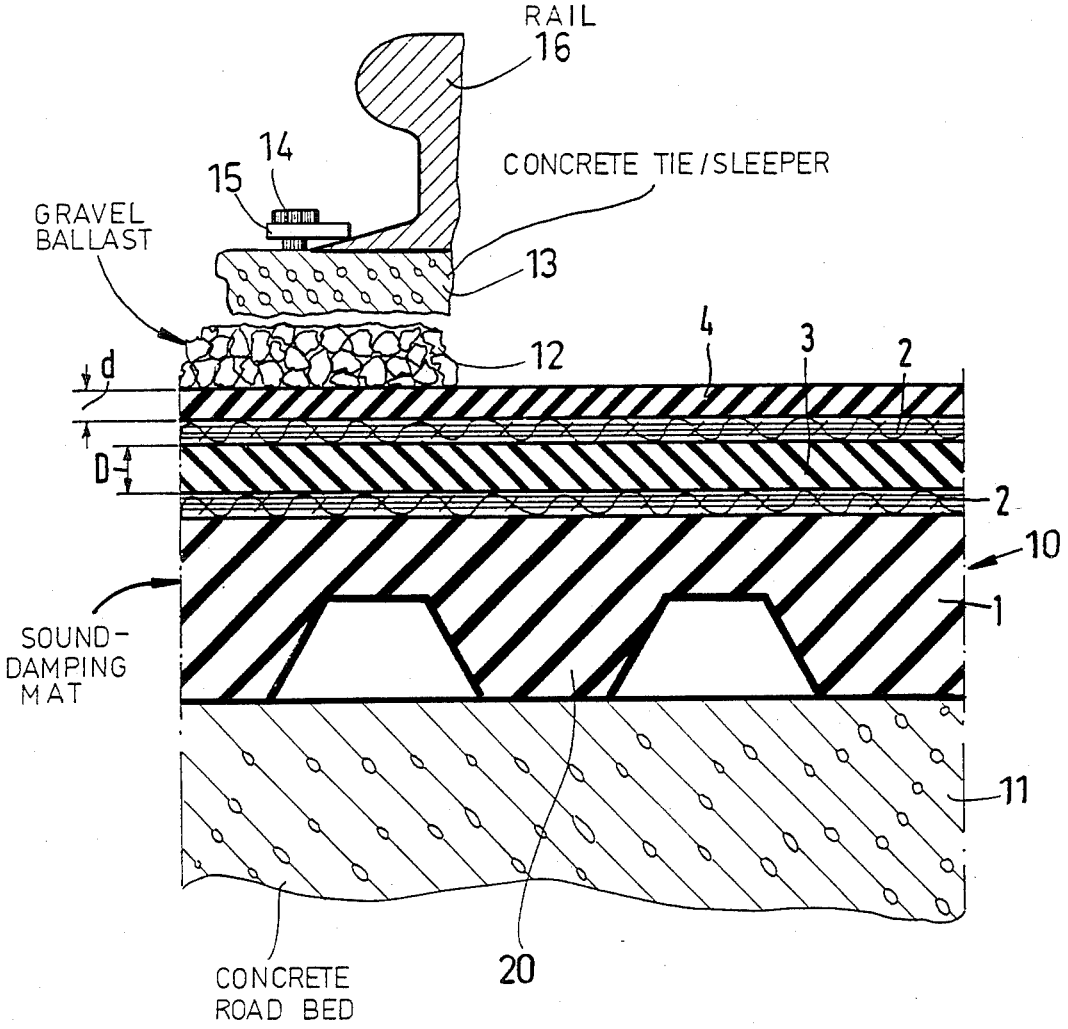
RAIL
16
14
15
CONCRETE TIE/SLEEPER
GRAVEL
BALLAST
13
4
3
2
12
d
D
2
10
1
SOUND-
DAMPING
MAT
11
CONCRETE
ROAD BED
20

RESILIENT BALLAST UNDERLAYMENT MAT INCLUDING NONWOVEN FIBER FLEECE LAYERS

FIELD OF THE INVENTION

My present invention relates to a resilient underlay for a ballast bed and, more particularly, to an underlay which has reduced penetrability.

BACKGROUND OF THE INVENTION

It is known to provide a mat of resilient material to be used as a base for a bed of broken stones of which the top side is a layer consisting of a material which is different from that of the main material of the mat. Such mats are used to carry, in an elastic manner, the bed of broken stones and the respective lines of rails against the foundation and against tunnel and trough walls in subways and for rail lines in order to effect a damping of rail-traveling sounds.

A mat of the above mentioned type the top side can be provided with a layer of elastically deformable material (DE-GM No. 80 13 779), for instance a bitumen layer. The broken stones can press themselves into this layer to a certain extent so that a more or less non-slip accumulation is achieved. The main disadvantage of this mat is that the sharp-edged broken stones within a short period of time also penetrate into the body of the mat whereby the mat is destroyed in such a way that finally it becomes only a granulated mass. However, a granulated mat is not capable of damping the rail sounds.

The mat can also be provided on its top side with a metal plate (DE-OS No. 31 21 946) which prevents a penetration of the broken stones into the mat. Indeed, this mat guarantees an especially effective damping of impact sound. However, the mat is not very flexible so that it can only be installed in relatively short lengths, a handicap in installation.

OBJECT OF THE INVENTION

To provide a mat for the purposes described which guarantees sufficient damping of sound, which prevents the penetration of broken stone, and which can be rolled up in order to be transported in long lengths to various locations of installation.

SUMMARY OF THE INVENTION

This object and others which will become more readily apparent hereinafter are attained in accordance with the invention in a mat which comprises an elastic body provided on its upper side with a layer of a fleece, i.e. of nonwoven fiber. More specifically, the penetration-preventing means can comprise a plurality of fleece layers between each two of which a further elastic layer (e.g. of elastomeric material) is provided.

Preferably above the uppermost fiber layer, an upper elastic layer is provided. Advantageously the thickness (d) of the uppermost elastic layer is about half the thickness (D) of the layer intermediate the fiber or fleece layers.

The uppermost or cover layer can be reinforced with or contain homogeneously distributed therein, fibers, e.g. the same fibers as form the fleece or mat. While synthetic resin fibers, e.g. of polyamide or polyester may be used, glass fiber is preferred for the reinforcement of the upper layer and for the or each fleece layer.

Furthermore, the nonwoven fabric to be provided at the top side of the mat enables an adjustment of the exalting degree of the resonant frequency, i.e. by the type of fabric and its position in the mat. Thus a damping of the impact sound according to the respective requirements can be brought about by the mat.

BRIEF DESCRIPTION OF THE DRAWING

The above and other objects, features and advantages of the present invention will become more readily apparent from the following description, reference being made to the accompanying drawing, the sole FIGURE of which is a cross sectional view of the mat showing it in relation to the ballast, tie and rail, all diagrammatically illustrated.

SPECIFIC DESCRIPTION

The mat 10 is provided as a sound-damping underlay above a foundation 11, e.g. of concrete, for a bed of ballast 12, i.e. broken stone, in which and on which rests the ties or sleepers 13.

The ties 13 can also be composed of concrete and carry the rails 16 which are secured to the ties by bolts 14 and hold-downs 15.

The mat 10 in the drawing has a body 1 of elastomeric material and is provided at its top side with a layer of double-ply nonwoven fabric or fleece whereby an intermediate layer 3 of resilient material is provided, between the individual layers of the fabric (layers 2). On top of the upper layer 2 of a double-ply fabric a covering plate 4 made of resilient material is provided, the thickness (d) of which is half as large as the thickness (D) of the intermediate layer 3.

The layers 1, 3 and 4 can be composed of rubber, the latter being reinforced by fibers. The fibers of the reinforcement and each of the fleece layers 2 can be glass fiber.

The underside of this layer 1 can be formed with prominences, projections, ribs or bosses 20 which bear on the foundation.

I claim:

1. In a road bed for railway rails, a sound-damping support assembly for the rails which consists of the combination of a ballast underlayment mat and a stone ballast on top of said mat, wherein said mat consists essentially of a body of elastomeric material formed at a bottom side thereof with prominent and projecting parts of said elastomeric material and at an upper side thereof with at least one layer consisting of a fiber fleece of nonwoven fiber limiting penetration of the stone ballast into the elastomeric material, a plurality of spaced apart layers of said fiber fleece of nonwoven fiber being provided at said upper side of said mat and said layers of fiber fleece being separated from one another by an intermediate resilient layer.

2. The assembly defined in claim 1 wherein a cover layer of an elastomeric material is provided on said mat above said fleece and resilient layers and between said stone ballast and an uppermost one of said fleece layers, said cover layer having a thickness which is about half the thickness of said intermediate resilient layer.

3. The assembly defined in claim 2 wherein said cover layer contains fibers.

4. In a road bed for railway rails, a sound-damping support assembly for the rails which consists of the combination of a ballast underlayment mat and a stone ballast on top of said mat, wherein said mat consists essentially of a body of elastomeric material formed at a bottom side thereof with prominent and projecting parts of said elastomeric material and at an upper side thereof with at least one layer consisting of a fiber fleece of nonwoven fiber limiting penetration of the stone ballast into the elastomeric material, a cover layer of an elastomeric material being provided on said mat above said fleece layer and between said stone ballast and said fleece layer.

5. The assembly defined in claim 4 wherein said cover layer contains fibers.

* * * * *